US005502910A

United States Patent [19]

Lucchesi

[11] Patent Number: 5,502,910

[45] Date of Patent: Apr. 2, 1996

[54] REAL ESTATE SIGN POLE

[76] Inventor: Frank Lucchesi, 14 Lighthouse Ct., Napa, Calif. 94559

[21] Appl. No.: 303,108

[22] Filed: Sep. 7, 1994

[51] Int. Cl.[6] ..... G09F 15/00

[52] U.S. Cl. ..... 40/606; 40/610; 248/156; 248/545; 173/91

[58] Field of Search ..... 40/606, 607, 610, 40/612; 248/156, 530, 544, 545; 173/90, 91

[56] References Cited

U.S. PATENT DOCUMENTS

| | | | |
|---|---|---|---|
| 4,249,715 | 2/1981 | Repp | 40/607 X |
| 4,326,352 | 4/1982 | Barth | 248/156 X |
| 4,357,772 | 11/1982 | Amick et al. | 40/606 X |
| 4,362,194 | 12/1982 | Lawson | 173/91 X |
| 4,524,533 | 6/1985 | Still, Jr. | 40/607 X |
| 4,700,655 | 10/1987 | Kirby | 40/610 X |
| 4,790,092 | 12/1988 | Farmer | 40/610 X |
| 4,790,392 | 12/1988 | Clements | 173/90 X |
| 5,083,390 | 1/1992 | Edman | 40/610 X |

FOREIGN PATENT DOCUMENTS

| | | | |
|---|---|---|---|
| 2637921 | 4/1990 | France | 40/606 |

*Primary Examiner*—Peter M. Cuomo
*Assistant Examiner*—James O. Hansen
*Attorney, Agent, or Firm*—Owen, Wickersham, and Erickson

[57] ABSTRACT

A temporary sign pole installation is disclosed which includes a hollow passage in a vertical pipe having a pointed bottom end. Vertical slots in the side of the hollow passage permit a handle to pass through the slots and into and/or through a pounder weight which can be moved up and down in the hollow core of the pipe. For the installation the pounder weight is moved by the handle emphatically downwards hitting the end of the vertical slot to pound the pipe into the ground. For removal of the pipe, the pounder handle constrained by the limits of the vertical slot is moved emphatically upward and drives the vertical pipe out of the ground. Various horizontal attachment pieces can be attached to the top of the vertical pipe to support an advertising sign or the like.

14 Claims, 4 Drawing Sheets

REAL ESTATE SIGN POLE

FIELD OF THE INVENTION

This invention relates to field of temporary sign poles, such as those commonly displayed in the front yards of residential properties to alert the passing public that the property is for sale.

BACKGROUND OF THE INVENTION

In recent years in the United States, the marketing and sale of homes and other single family dwellings has become increasingly competitive. As a result, the manner in which real estate is advertised has become increasingly important. An important part of the advertising program is the use of real estate signs planted in the front yards of residential homes to alert the public to the availability of that property. It is therefore important that such signs be quickly and easily installed once a property is listed for sale and that such signs similarly be quickly and easily removed when the time for advertising or sales promotion has ended.

Real estate brokerage firms typically hire an independent contractor to erect and take down such signs. Use of an independent contractor increases the expense and delays the installation and removal of the sign until the order for installation or removal can be processed and scheduled. The most attractive signs are large and provide an attractive eye-catching appearance to potential customers. But a drawback of these large, eye-catching signs is that there are generally large and cumbersome and must be installed deep into the ground to prevent them from falling over. Generally when a 4-by-4-type post is used, a hole must be dug for installation and such a hole must be filled in after removal of the sign post.

Other signs present a similar appearance to a 4-by-4 post but actually are hollow lightweight structures which fit over a strong metal rod which has been hammered into the ground (e.g. U.S. Pat. No. to DesNoyers et al. No. 4,843,746 and the references cited therein). The rod is usually three to four feet long and is driven into the ground by hammering, usually using a large hammer. Once the rod is in place the hollow lightweight structure replicating the appearance of a large wooden post is slipped over the rod in a hole for receiving the rod to support the above ground sign post structure. For the sign post to remain stable, the post must fit tightly with the rod to prevent swaying of the sign post. A swaying sign detracts from the quality impression that a real estate broker wants to convey. Therefore, the fit between the hole in the end of the post which receives the end of the rod must be tight or the hollow sign post must be otherwise clamped to the rod. To drive such a rod into the ground, a hammer must hit the end of the rod. Since the hammer does not always strike the end of the rod from the end perfectly, the end of the rod after a period of use tends to spread in a mushroom-like shape. The enlarged end of the rod must be cut off or otherwise repaired so that the top end, now mushroomed shaped, can still fit tightly into the hole in the replicated sign post.

Other real estate sign structures are less imposing and closer to the ground. They use a frame having a flat plate from which stakes protrude toward the ground. These sign structures are often installed by the installer using his or her body weight to drive the stakes into the ground. Usually two or more ground support legs are utilized in this type of sign support.

In other instances vertical boards such as 4-by-4's are driven into the ground in parallel and signs are nailed across the span between the two boards.

While in each of the above-mentioned examples there is a provision for securing the post in the ground, it is also true that in each of these examples there is virtually no provision to assist in removal of the sign posts or ground rods from the ground. The removal of the ground rod stakes or boards set into the ground is left up to the user in the best fashion that he or she can figure out. A removal of stakes or rods or posts driven into the ground can require greater effort and skill for removal than installation. The frictional force applied by the ground to the rod post or stake can sometimes be very high. When driving a rod into the ground, a user is assisted and the needed force is obtained by using a large hammer. However, there is no provision for similar assistance in removal of the rod stake or post imbedded in the ground.

For a sign post to be valuable, it must be secured in the ground with sufficient force to overcome the transverse forces generated by the wind and repeated gentle touching by potential buyers who remove advertising sheets held in a mailbox type container mounted on the sign post, or from incidental contact with a grass mower when the grass near the post is being cut. Since the sign post is often in place for several months, the initial sign post installation must be very sturdy to overcome such environmental conditions and support the sign in an aesthetically pleasing manner to provide a professionally competent sales appearance to potential buyers.

SUMMARY OF THE INVENTION

A configuration of a sign post according to the invention provides a post with a removable pounding mechanism to assist in installing the sign post when it is driven into the ground and similarly this same pounding mechanism is used to pound the sign post when it is driven out of the ground.

A configuration according to the invention consists of a pipe-type hollow tube pointed at the bottom with vertical slots in its sides. A pounder weight is inserted into the central hollow tube and a pounder weight handle fits through a hole in the pounder weight and through the vertical slots in the sides of the hollow tube. The top and bottom edges of the vertical slots acts as limits for the pounder weight handle and prevent the pounder weight hole from moving beyond the upper and lower limits of the vertical slot.

During installation of the sign post, the pointed bottom end is placed at the desired installation location on the ground and the pounder weight is raised and emphatically lowered using the pounder handle, when the pounder handle reaches the bottom edge of the vertical slot, the momentum of the pounder handle and pounder weight which is moving quickly downwards is imparted to the wall of the hollow sign post and assists in driving the pointed bottom end of the sign post into the ground. The pounder weight and handle are repeatedly raised up to the top edge of the vertical slot and then emphatically lowered until the sign post is driven to a depth in the ground sufficient to securely hold it for the duration of its temporary existence at that location. The pounder handle is then removed from the pounder weight and slots in the sides of the vertical pipe and the pounder weight is removed leaving an undamaged top end of the base pipe to which a pipe support (sign supporting) extension can be attached.

Similarly, when removal of the sign post is desired, the pipe (sign supporting) extension is removed and the pounder weight is installed in the hollow core of the lower vertical pipe. The pounder handle is then inserted through the vertical slots in the sides of the pipe and through the handle receiving hole of the pounder weight. The pounder weight is then moved by using the pounder handle from its low position in the vertical slot, emphatically towards its own top edge. The momentum generated by the upwardly moving pounder weight and pounder handle provides an upward driving force which is transferred to the pipe when the pounder handle hits on the upper edge of the pipe's vertical slot. Repeated upward strokes eventually pull the pipe from the ground. Once the pipe is pulled out of the ground, the pounder handle can again removed so that the sign post can be easily transported and stored in a small space.

A configuration according to the invention can include a collar that is attached to the vertical pipe at the lower edge of the vertical slot. This collar increases the metal area over which the force of the handle impact can be distributed to reduce a likelihood of localized damage to the pipe wall material from the impact of the pounder driving the pipe into the ground. This collar also can support a sleeve which can be slipped over the outside of the pipe to cover the vertical slots and prevent contamination of the inside of the pipe during use. The collar supports the lower end of such a hollow sleeve.

When the sign post is a continuous hollow pipe, there is a danger that the rod shaped (pounder weight), which fits inside the hollow opening of the pipe, could fall down into the opening beyond the vertical slots in the sides of the pipe. To remove or retrieve the pounder weight in such a situation, the pipe would have to be removed and turned upside down to get the pounder weight to slip back out, or some other means would have to be available to grab the pounder weight to pull it back from the position where it had fallen. To overcome this drawback an end flange is provided at the top end of the pounder weight. The end flange extends beyond the edge of the hollow core of the vertical sign post so that the pounder weight does not fall into the hollow cavity in the top of the sign post.

Flared pipe extension sections and/or other similar connection extensions can be provided to attach a for sale or other similar-type signs to the installed vertical pipe.

In this configuration the location where the pounding weight impacts the vertical post is located away from the end of the post so that the end is not damaged from pounding. This provides an undamaged end piece to which sign support extensions can be repeatably and reliably connected. A sign post according to this invention can be easily transported and stored in a webbed velcro strap-type rack and can be easily be installed and removed without great difficulty by a normal real estate salesperson in a normal residential front yard type setting. When utilizing this configuration, the real estate salesperson can immediately display his or her for sale sign and inform the public of the sale without having to delay until a sign installation and/or removal person can be called and the sign installed by that other person.

Installation and removal of this configuration as disclosed herein also presents a new method of installing and removing a sign pole as discussed below.

DETAILED DESCRIPTION

Figure 1:
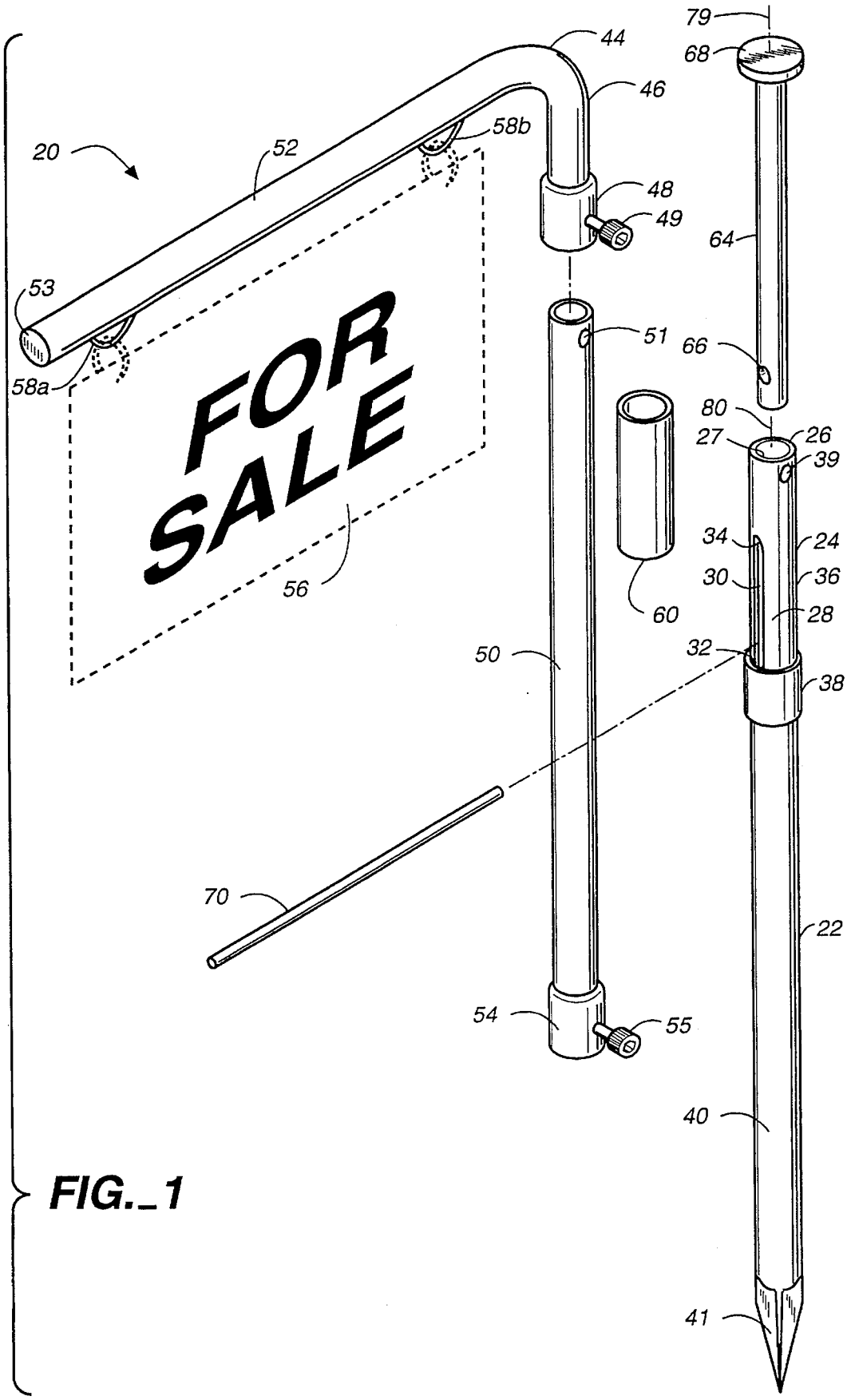
FIG. 1 shows an exploded view of a configuration of a real estate sign pole according to the invention.

FIG. 1 shows an exploded assembly diagram of a sign post configuration 20 according to the invention. A vertical pipe (upper tubular section, lower member, lower pole member) 22 includes a bottom end (lower tubular section, lower end) 40 which is configured to end in a point (point, pointed end, pointed lower end, pointed bottom end piece) 41. The vertical pipe 22 includes a top end (upper end, upper tubular section) 24 having a side (outside surface) 28 having a first vertically slotted hole (elongated side opening, generally vertical slot, slot, uninterrupted continuous perimeter, slot in a member, enclosed hole in a side of the vertical pipe) 30 opposed to a second vertically slotted hole 36. These vertically slotted holes 30, 36 include a bottom edge (lower edge, lower end, bottom end of slot) 32 and an upper edge, (upper end, top end of slot) 34. A collar (metal strap, anchor ring on side of bottom piece at bottom of slot) 38 is provided around the circumference of the vertical pipe 22 such that the top edge of the collar 38 is generally coincident with the bottom edge 32 of the vertical slots 30, 36.

The top end 24 of the pipe 40 includes a top (top of said top end) 26 which is the extreme top surface of the vertical pipe 22. The vertical pipe 22 includes a central axis 80. The central axis 80 is aligned with a pounder weight receiving hole (hollow passage, hollow core generally parallel to and collinear with the vertical access) 27 which receives a similarly configured pounder weight 64. The pounder weight receiving hole/hollow passage 27, while shown here as round, can be configured in any other desired configuration such as rectangular or triangular subject only to the limitation that when the pounder weight (pounder shaft) 64 is inserted, that the vertical pounder weight be able to move freely along the longitudinal axis (generally parallel to a longitudinal axis of the lower section/pipe, vertical axis) 79, which is generally coincident with the pipe central axis 80. A screw receiving hole (middle piece bottom end flair Allen screw receiving hole) 39 is located adjacent to the top 26 of said top end 24 of the vertical pipe 22.

Figure 5:
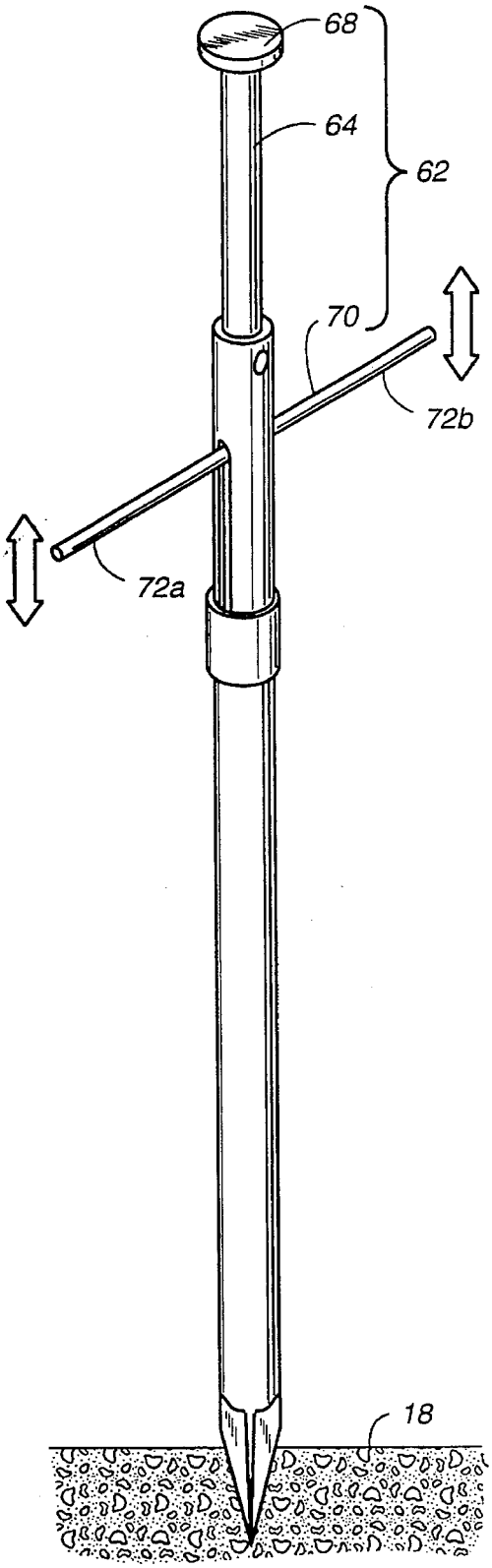
FIG. 5 shows the configuration according to the invention with the pounder installed and located at its highest normal operating position.

A pounder assembly 62 (ref. FIGS. 1 and 5) as herein described includes a pounder weight (pounder shaft) 64 with a hole in its side (pounder cross piece receiving hole, hole) 66, an end flange (pounder head) 68, and a pounder handle 70. The pounder handle 70 fits into the hole 66 in the side of the pounder weight and through the vertical slots 30, 36 in the side of the vertical pipe 22 when the pounder assembly 62 is in position to assist in driving the vertical pipe 22 for installation or removal. When the pounder assembly 62 is not in position and the pipe 22 is ready for use, a tubular sleeve (cover for pole slot, sleeve to cover slot) 60 can be slipped over the top end 24 of the vertical pipe 22 to cover the vertical slots 30, 36 to provide an aesthetically pleasing outside appearance and prevent moisture and other corrosion enhancing contaminants from entering the pipe through the side slots 30, 36.

Figures 2, 3, 4:
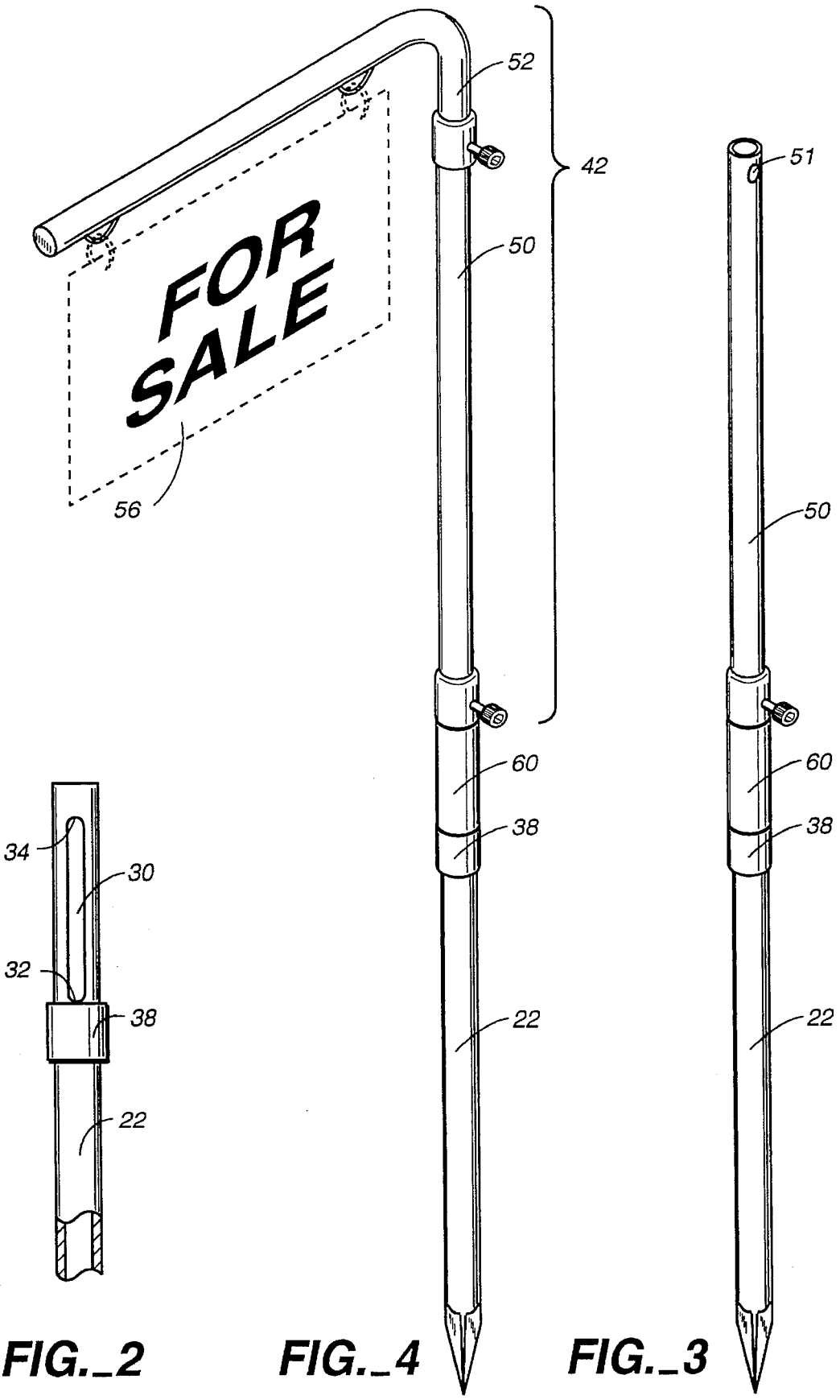
FIG. 2 shows an elevation side view of vertical slots in the sides of the lower sign post of FIG. 1.
FIG. 3 shows a configuration according to the invention where the vertical slots of the lower member have been covered by a sleeve and an intermediate extension member has been attached.
FIG. 4 shows a horizontal cantilevered sign supporting tube attached to the top of the configuration as shown in FIG. 3.

A side view of the vertical slot 30 (corresponding to vertical slot 36 on its opposite side) is shown in FIG. 2. The top and bottom edges 34, 32 of the slots 30, 36 establish a closed perimeter hole such that when the handle 70 is inserted through the slots and the pounder weight 64 the handle cannot move beyond the upper and lower edges 34, 32 of the slots 30, 36.

Figure 6:
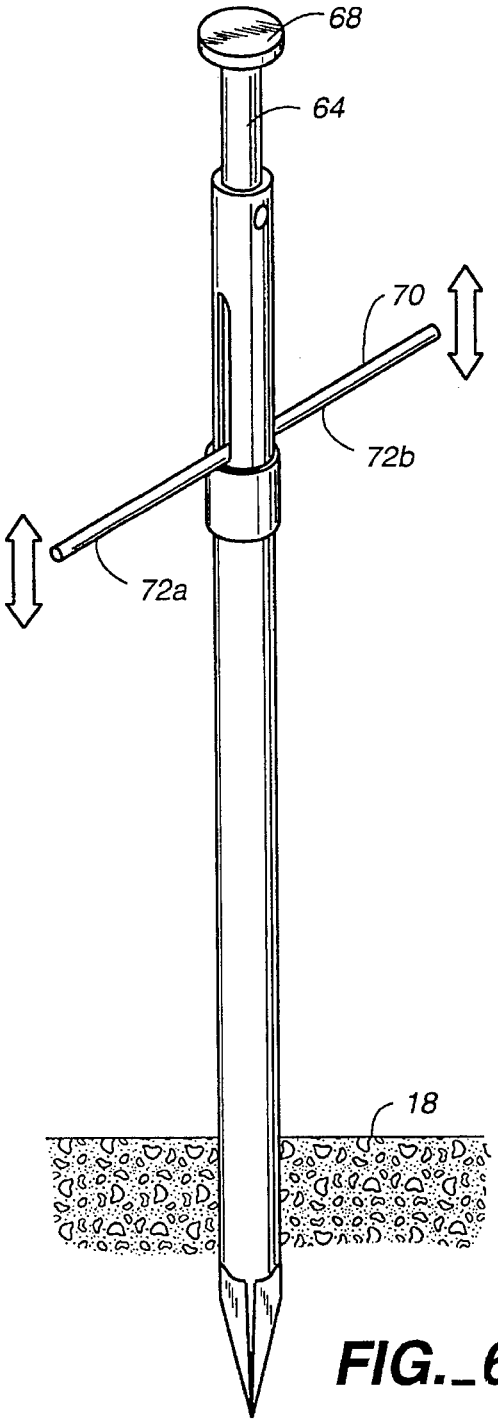
FIG. 6 shows a sign post configured according to the invention being driven into the ground and the pounder in its lowest normal operating position.

The installation and removal of the vertical pipe 22 using the pounder 62 is shown in FIGS. 5 and 6. The pounder assembly 62 is positioned in the hollow passage 27 in the top end 24 of the pipe 22 with the pounder handle 70 sticking through and out both sides of the pipe 22. The pointed end 41 of the pipe 22 is placed at its desired location in a vertical attitude on the ground and then the post installer person grabs the hand holds 72*a*, 72*b* of the pounder handler 70 on either side of the vertical pipe. The installer person (user) raises the handle thereby raising all pieces of the pounder assembly 62 to the upper limit of the vertical slots 30, 36. The user then emphatically urges the pounder assembly 62 down until it vigorously impacts the lower edge 32 of the vertical slots 30, 36. This action causes a pounding-hammering action which drives the vertical pipe 22 deep into the ground 18. When the vertical pipe 22 has been driven into the ground far enough so that the whole sign post assembly can be securely supported in the ground, then the pounder assembly 62 is removed, and the remainder of the sign post assembly 20 can be installed. Installing the horizontal pipe (sign support) 42 involves placing the flared end section (pole flare, horizontal piece flare) 48 over the top 26 of the top end 24 of the vertical pipe 22. The Allen head clamping screw (horizonal piece flare Allen screw) 49 is screwed in to clamp against the side of the top end 24 of the vertical pipe 22, or in another arrangement the screw 49 passes into a screw receiving hole (middle piece bottom end flare Allen screw receiving hole) 39 which can mechanically restrain horizontal pipe 42 from being lifted off or accidentally falling off the top of the vertical pipe 22. The horizontal pipe 42 is installed adjacent and on top of the tubular sleeve 60 covering the vertical slots 30, 36.

The horizontal pipe 42 includes a flared end section 48 having an Allen-head screw 49 connected to the bottom end of the a vertical section 46 connecting to the elbow (horizontal piece elbow) 44 supporting a horizontal pipe extension section (top, horizontal piece) 52. The horizontal piece 52 is closed at its end by an end cap (horizontal piece end cap) 53 and two hooks 58*a*, 58*b* which are configured to support a sign 56 hanging from the horizontal piece 52.

In instances where it is desired that the sign be greatly elevated from the vertical pipe 22, a vertical pipe extension section (middle piece) 50 is used as part of the horizontal pipe 42 to extend the vertical section 46 of the horizontal piece so that elevation of the sign 56 is increased. The vertical pipe extension 50 includes end fittings which match the end fittings on the horizontal pipe 42 and the end of the vertical pipe 22. The bottom of the vertical pipe extension section 50 includes a flared end section (middle piece bottom end flare) 54 with a clamp (middle piece bottom end flare Allen screw) 55. When needed, the top of the middle section also includes a screw receiving hole (horizontal flare piece Allen screw receiving hole) 51.

The sequence of assembly of the pole assembly 20 is shown in FIGS. 3 and 4. Once the vertical pipe 22 is located and pounded into the ground by the pounder assembly 62, the pounder assembly 62 is removed and the tubular sleeve 60 is slipped over the vertical slots 30, 36. The flared end 54 of the vertical pipe extension section 50 is then placed over the top 26 of the top end 24 of the vertical pipe 22 and fastened to it using the Allen screw 55. The horizontal piece 42 is then attached to the top end of the vertical pipe extension section 50 in a similar manner and the clamp end Allen clamping screw 49 secures the final part of the support piece of the pole assembly 20. (The sign 56 is then attached.)

When the sign post assembly 20 is to be taken down, the process is reversed. The horizontal pipe 42 is removed, the vertical pipe extension section 50 is removed, the tubular sleeve 60 is removed and the pounder assembly 62 is installed in the hollow passage 27 in the center of the top 26 of the vertical pipe 22. The pounder assembly 62 is then moved emphatically upwards to drive the vertical pipe 22 from the ground.

From the above-described installation and removal sequence, a person of ordinary skill in the art of this invention will recognize that it includes a method of installing and removing any sign pole comprising the steps, for installation of, locating the pipe at an installation location, placing the pounded weight in the hollow passage, inserting the pounder handle through a vertical slot in the side of the pipe and raising the pounder weight by the handle, and energetically assisting the pounder weight's descent to drive the pointed lower end into the ground; and for removal of, placing the pounder weight in the hollow passage of the pipe, inserting the pounder handle through the vertical slot in the side of the pipe, and into the pounder weight; holding the pounder weight handle, and energetically raising the pounder weight to impact the upper end of the slot to impart a vertical pounding force to drive the pointed lower end from the ground.

Figure 7:
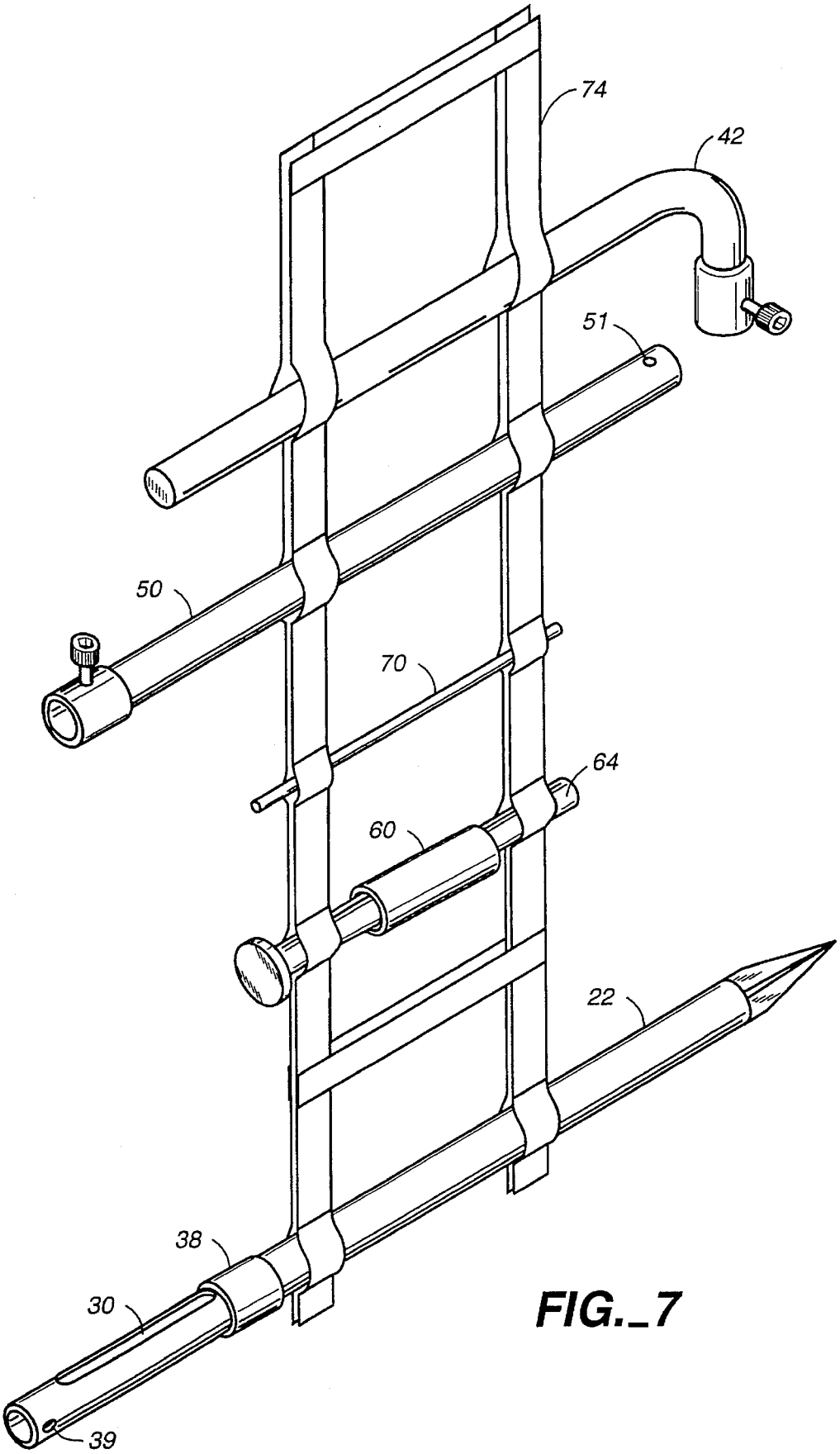
FIG. 7 shows a carry strap/storage belt which supports pieces of the configuration of the invention.

FIG. 7 illustrates a carrying strap (storage belt rack) 74 which captures the various pieces of the configuration of the invention described in one unit so that they can be carried. The pieces can be countered by snaps or other attachment means such as preferably Velcro® so that the pieces for each individual unit are discreetly captured within one carrying strap 74 such that if several of these units were in a person's trunk, they would just have to remove this strap and all of the correct pieces for installing one pole sign according to the invention would be lifted out and could be easily transported in use to the actual installation site.

While the invention has been described with regards to specific embodiments, those skilled in the art will recognize that changes can be made in the form and detail without departing from the spirit and scope of the invention.

I claim:

1. A sign post comprising:

a vertical pipe having a top end, said vertical pipe having a first vertically slotted hole in a side thereof;

a horizontal pipe supported by and removably connected to said top end of said vertical pipe; and a sign supported by said horizontal pipe, wherein said vertical pipe has a second vertically slotted hole in a side of said vertical pipe opposite said first vertically slotted hole, wherein said vertical pipe includes a collar surrounding said vertical pipe at a location at a bottom edge of said first and said second vertically slotted holes.

2. A sign post as in claim 1, further comprising:

a tubular sleeve configured to slip over said top end of said vertical pipe to cover said first and said second vertically slotted holes and be supported by said collar surrounding said vertical pipe.

3. A sign support as in claim 2, wherein said horizontal pipe includes an elbow and a vertical section having a flared end section with a clamp to attach to said top end of said vertical pipe.

4. A sign support as in claim 3, wherein said horizontal pipe includes a vertical pipe extension section removably connected to a horizontal pipe extension section by providing a flared pipe section with a clamp on one side of the connection and providing a pipe section over which the flared section fits on a second side of the connection.

5. A sign post comprising:

a vertical pipe having a top end, said vertical pipe having a first vertically slotted hole in a side thereof;

a horizontal pipe supported by and removably connected to said top end of said vertical pipe;

a sign supported by said horizontal pipe; and a pounder weight configured to extend into said top end of said vertical pipe, said pounder weight having a hole in its side whose orientation and location correspond to the orientation and location of said first vertically slotted hole such that when said pounder weight is positioned in said top end of said vertical pipe and said hole in said pounder weight is aligned with said first vertically slotted hole;

a pounder handle which passes through said first vertical slot to engage said hole in a side of said pounder weight such that when said handle together with said pounder weight are moved upward their movement is limited by an upper edge of the first vertically slotted hole while when said handle together with said pounder weight are moved downward their movement is limited by a lower edge of the first vertically slotted hole.

6. A sign post comprising:

a vertical pipe having a top end, said vertical pipe having a first vertically slotted hole in a side thereof, and a second vertically slotted hole in a side of said vertical pipe opposite said first vertically slotted hole;

a horizontal pipe supported by and removably connected to said top end of said vertical pipe;

a sign supported by said horizontal pipe;

a pounder weight configured to extend into said top end of said vertical pipe, said pounder weight having a hole in its side whose orientation and location correspond to the orientation and location of said first vertically slotted hole such that when said pounder weight is positioned in said top end of said vertical pipe and said hole in said pounder weight is aligned with said first vertically slotted hole: and a pounder handle which passes through said first vertical slot to engage said hole in a side of said pounder weight such that when said handle together with said pounder weight are moved upward their movement is limited by an upper edge of the first vertically slotted hole while when said handle together with said pounder weight are moved downward their movement is limited by a lower edge of the first vertically slotted hole.

7. A sign support as in claim 6, wherein said pounder handle passes through said first vertically slotted hole, through said hole in said pounder weight, and through said second vertically slotted hole to provide hand holds on said pounder handle on either side of said vertical pipe.

8. A sign support as in claim 7, wherein said pounder weight is configured to include an end flange which is configured to act as a stop on a top of said top end of said vertical pipe so that when said pounder weight extends into said top end of said pipe, said end flange prevents said end flange of said pounder weight from moving into said top of said top end of said vertical pipe.

9. A sign support comprising:

a pounder weight and a pounder handle;

a lower tubular section being pointed at a bottom end thereof, said lower section having a top end which is hollow and includes a slot from an outside thereof to an inside thereof, said slot having a uninterrupted continuous perimeter and having a longitudinal axis generally parallel to a longitudinal axis of said lower section, such that said top end of said lower section forms a center cavity enabling said pounder weight to move freely generally along said longitudinal axis of said lower section;

wherein said pounder weight includes a hole for engaging said pounder handle, said hole in said pounder weight being oriented to face said slot in said lower section so that said pounder handle can engage said hole in said pounder weight through said slot.

10. A sign support as in claim 9, further comprising:

an upper tubular section connected to said lower section.

11. A sign support as in claim 10, further comprising:

a sign supported by said upper tubular section.

12. A sign support comprising:

a lower member, having a lower end and an upper end, said lower end having a vertical axis, said upper end having a hollow core generally parallel to and collinear with said vertical axis, said upper end having a first slot in a wall of said member between said hollow core and an outside of said member and a second slot in a wall of said member between said hollow core and an outside of said member, wherein said first slot is aligned with said second slot to allow a pounder handle to pass through said first slot, through a pounder handle opening of a pounder weight disposed at said hollow core, and on through said second slot opening, wherein said lower end is configured to end in a point, and said upper end of said member is configured to support a sign.

13. A sign support pole comprising:

a lower member having a longitudinal axis extending between a lower end and an upper end thereof, said upper end of said lower member including a pounder weight receiving hole extending from a top end of said member into said member along said longitudinal axis, said lower member further having an elongated side opening connecting said pounder weight receiving hole to an outside surface of said lower member such that a pounder handle positioned in an orientation generally perpendicular to said longitudinal axis extends through said side opening and a pounder weight when positioned in said pounder opening and extends through said side opening in an orientation generally perpendicular to said longitudinal axis, such that said pounder handle is moved with said pounder weight along said longitudinal axis to provide a pounding force to either a top end or a bottom end of said side opening, said elongated side opening being configured to allow said pounder handle to follow said pounder weight as it moves toward said top end or said bottom end of said side opening, wherein a sign support can be attached to an upper end of said lower member.

14. A method of installing and removal of a sign pole comprising the steps of:

for installation:

locating a lower pole member having a pointed lower end at an installation location;

placing a pounder weight in a hollow passage of said lower pole member;

inserting a pounder handle through a generally vertical slot in the side of said lower pole member and through a hole in the pounder weight;

raising said pounder weight by raising said handle and energetically assisting the pounder weight's descent to stop on a lower end of said generally vertical slot thereby imparting a pounding force on said lower pole member to drive the pointed lower end into the ground; and for removal placing a pounder weight in a hollow passage of said lower pole member;

inserting a pounder handle through a generally vertical slot in the side of said lower pole member and through a hole in the pounder weight;

holding said pounder handle in said generally vertical slot below an upper end of said generally vertical slot and energetically raising said pounder weight and said pounder handle to impact said upper end of said generally vertical slot thereby imparting a pounding force on said lower pole member to drive the pointed lower end from the ground.

* * * * *